United States Patent [19]

Murakami

[11] Patent Number: 4,849,796

[45] Date of Patent: Jul. 18, 1989

[54] COPY STORING TRAY ASSEMBLY

[75] Inventor: Susumu Murakami, Osaka, Japan

[73] Assignee: Sharp Kabushiki Kaisha, Osaka, Japan

[21] Appl. No.: 25,723

[22] Filed: Mar. 13, 1987

[30] Foreign Application Priority Data

| | | | |
|---|---|---|---|
| Mar. 14, 1986 | [JP] | Japan | 61-57458 |
| Mar. 14, 1986 | [JP] | Japan | 61-57459 |
| Mar. 14, 1986 | [JP] | Japan | 61-57460 |
| Mar. 19, 1986 | [JP] | Japan | 61-62544 |

[51] Int. Cl.[4] ..... G03G 15/00; B65H 7/02

[52] U.S. Cl. ..... 355/206; 271/3.1; 355/321

[58] Field of Search ..... 355/3 SH, 14 SH, 72, 355/23–26, 14 CU; 271/207, 227, 228, 171, 258, 259, 3.1, 243–245, 248

[56] References Cited

U.S. PATENT DOCUMENTS 4,697,911 10/1987 Kajita et al. ..... 355/14 SH X

FOREIGN PATENT DOCUMENTS 58-57144 4/1983 Japan .
58-105248 6/1983 Japan .
59-102254 6/1984 Japan ..... 355/3 SH
59-212331 12/1984 Japan .
60-26544 2/1985 Japan .
60-61429 4/1985 Japan .
61-156061 7/1986 Japan .
2141109 5/1984 United Kingdom .

*Primary Examiner*—A. T. Grimley
*Assistant Examiner*—J. Pendegrass
*Attorney, Agent, or Firm*—Birch, Stewart, Kolasch & Birch

[57] ABSTRACT

A copy storing tray for storing copy paper sheets, including a paper detection device, a pair of side regulating plates for regulating the lateral position of the copy paper sheets, at least one of which is movably provided so as to be displaced in a lateral direction, and an actuator device for displacing at least one of the side regulating plates. As each of the copy paper sheets is supplied to the copy storing tray, one of the side regulating plates is displaced in the lateral direction by the actuator device so as to displace each of the copy paper sheets to a predetermined position such that each of the copy paper sheets is not detected by the paper detection device.

8 Claims, 7 Drawing Sheets

COPY STORING TRAY ASSEMBLY

BACKGROUND OF THE INVENTION

The present invention generally relates to a copying apparatus particularly, to a copy storing tray for storing supplied copy paper sheets to be refed, etc., such as an intermediate copy tray provided in an automatic duplex copying apparatus.

Conventionally, in an automatic duplex copying apparatus, it has been so arranged that copy paper sheets each having one copied face are temporarily stored in an intermediate copy tray and again delivered from the intermediate copy tray to a copying process portion after exchange of the original document. In a copy storing tray such as the intermediate copy tray for storing the copy paper sheets to be refed, all the supplied copy paper sheets should be accurately stored at a position for storing the copy paper sheets. Meanwhile, in the case where a jam of the copy paper sheets has taken place in the vicinity of the copy storing tray, the jam should be detected immediately so as to be promptly dealt with by the operator.

To this end, in a known intermediate copy tray 73 of FIG. 1, a detection switch 72 for detecting the copy paper sheets is provided in the vicinity of a pair of paper feed rollers 71 for supplying the copy paper sheets to the intermediate copy tray 73 and a detection switch 74, for detecting the copy paper sheets, is mounted on a bottom face of the intermediate copy tray 73. By this arrangement of the known intermediate copy tray 73, jam of the copy paper sheets occurring at a location preceding the paper feeding rollers 71 and jam of the copy paper sheets occurring prior to storage of the copy paper sheets in the intermediate copy tray 73 after the copy paper sheets have been passed through the paper feed rollers 71 are detected. In the known intermediate copy tray, occurrence of the latter jam is determined by detecting that the detection switch 74 is not turned on after the detection switch 72 has been turned off. However, in the known intermediate copy tray 73, in the case where a plurality of the copy paper sheets are continuously supplied to the intermediate copy tray 73, the detection switch 74 is turned on by the first copy paper sheet and is held in the ON state during continuous supply of the subsequent copy paper sheets to the in copy tray 73, regardless of whether or not a jam of the subsequent copy paper sheets has taken place between the paper feed rollers 71 and the intermediate copy tray 73. Thus, at this time, even if a jam of the subsequent copy paper sheets takes place between the paper feeding rollers 71 and the intermediate copy tray 73, the jam is not detected until the detection switch 72 is held in the ON state upon stop of the next copy paper sheet through its collision with the jammed copy paper sheets. Therefore, in the known intermediate copy tray 73, jam of a plurality of the copy paper sheets undesirably takes place due to a delay in the start of the operation for eliminating the jam. Hence, the known intermediate copy tray 73 has such drawbacks that the operation for eliminating the jam becomes complicated and time-consuming and the copying apparatus may be readily damaged by the jam.

SUMMARY OF THE INVENTION

Accordingly, an essential object of the present invention is to provide a copy storing tray in which when a plurality of copy paper sheets are continuously supplied to the copy storing tray, proper supply of each of the copy paper sheets to the copy storing tray is detected such that an operation for eliminating jam of the copy paper sheets can be performed immediately through prompt detection of the jam of the copy paper sheets, with substantial elimination of the disadvantages inherent in conventional copy storing trays of this kind such as illustrated by FIG. 1.

Another important object of the present invention is to provide a copy storing tray of the above described type in which the operation for eliminating the jam of the copy paper sheets is simplified and it is possible to prevent damage to the copying apparatus due to the jam of the copy paper sheets.

In order to accomplish these objects of the present invention, there is provided a copy storing tray for storing copy paper sheets according to one preferred embodiment of the present invention, which is provided with a detection means for detecting the copy paper sheets at the time of supply of the copy paper sheets to the copy storing tray, the improvement comprising a pair of side regulating plates for regulating, in a lateral direction perpendicular to a direction of supply of the copy paper sheets to the copy storing tray, a position of the copy paper sheets stored in the copy storing tray, at least one of which is movably provided so as to be displaced in the lateral direction and an actuator means for displacing the one of the side regulating plates in the lateral direction, whereby at the time when each of the copy paper sheets has been supplied to the copy storing tray, the one of the side regulating plates is displaced in the lateral direction by the actuator means so as to displace each of the copy paper sheets to a predetermined position each of the copy paper sheets is not detected by the detection means.

BRIEF DESCRIPTION OF THE DRAWINGS

These objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 4:
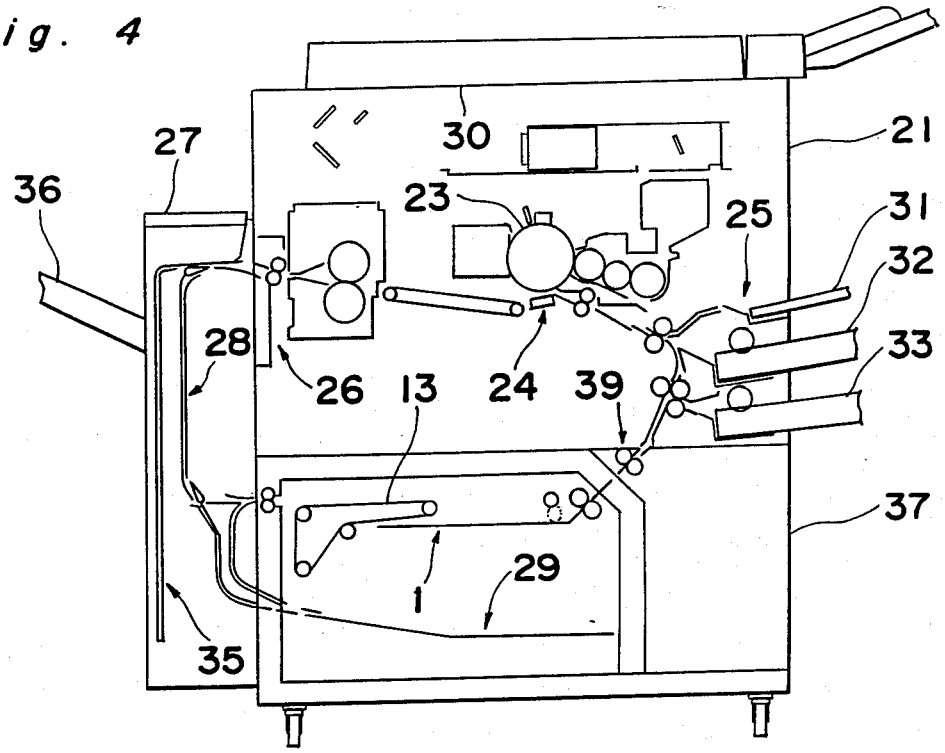
FIG. 4 is a schematic sectional view of a copying apparatus in which the intermediate copy tray of FIG. 2 is provided.

FIG. 4 shows a copying apparatus which is provided with an intermediate copy tray 1 acting as a copy storing tray, according to a first embodiment of the present invention. A photosensitive (photoreceptor) drum 23 is provided at a central portion of an apparatus housing 21 so as to constitute a copying process portion 24. At the right side of the copying process portion 24, a paper feeding tray 31 and paper cassettes 32 and 33 are loaded into the apparatus housing 21 so as to constitute a paper feeding portion 25. Meanwhile, a paper discharge portion 26 is provided at the left side of the copying process portion 24 and a sorter 27 is mounted on an outside of the paper discharge portion 26. In the sorter 27, a main transport path 35 and an auxiliary transport path 28 are defined.

The apparatus housing 21 is placed on a cabinet 37. In the cabinet 37, a switchback transport path 29 and intermediate copy tray 1 acting as the copy storing tray of the present invention are provided. Copy paper sheets introduced into the main transport path 35 are ejected into a bin 36, while copy paper sheets carried into the auxiliary transport path 28 are supplied to the intermediate copy tray 1 by way of the switchback transport path 29 or directly. The copy paper sheets stored in the intermediate copy tray 1 are again conveyed to the copying process portion 24 via a passage 39.

Figure 1:
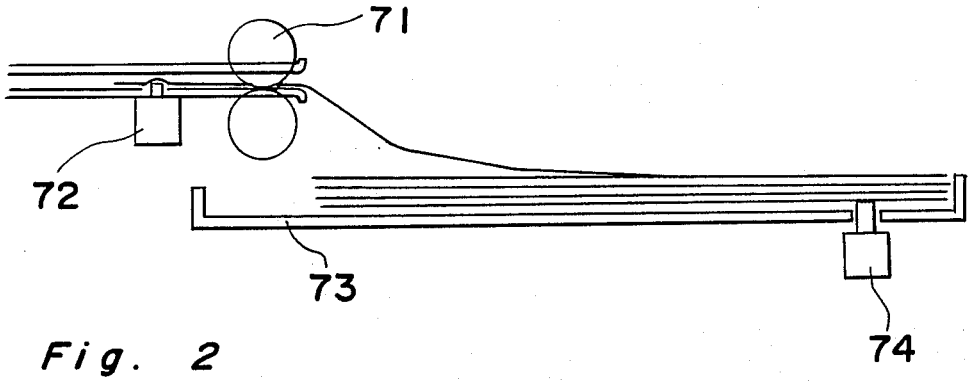
Fig. 1 PRIOR ART
FIG. 1 is a front elevational view of a prior art intermediate copy tray.
Figure 2:
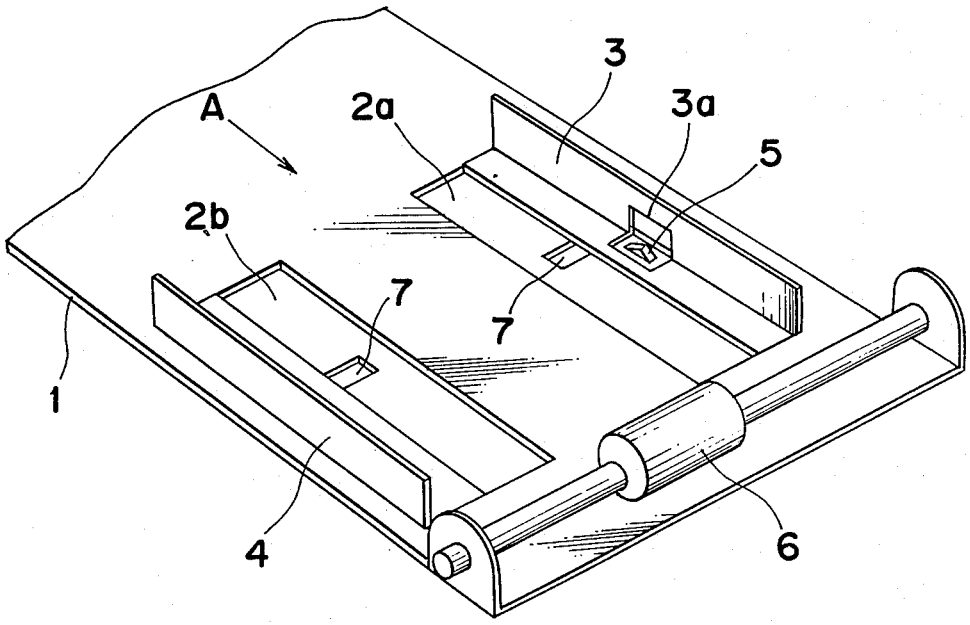
FIG. 2 is a fragmentary perspective view of an intermediate copy tray according to a first embodiment of the present invention.
Figure 3:
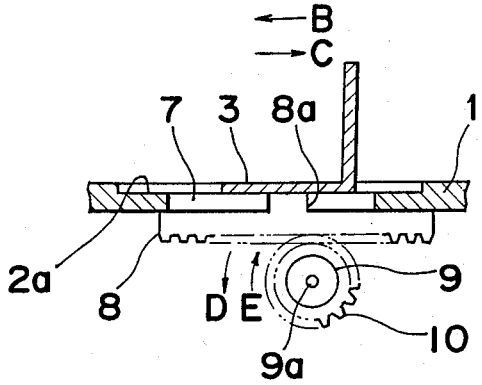
FIG. 3 is a fragmentary sectional view of the intermediate copy tray of FIG. 2.

FIGS. 2 and 3 show the intermediate copy tray 1 in more detail. Copy paper sheets are transported in the direction of the arrow A of FIG. 2 in the intermediate copy tray 1. The intermediate copy tray 1 is formed, on its upper face, with a pair of recessed portions 2*a* and 2*b* extending in the direction of the arrow A. A pair of side regulating plates 3 and 4 of substantially L-shaped cross section for regulating lateral positions of the copy paper sheets stored in the intermediate copy tray 1 are, respectively, fitted into the recessed portions 2*a* and 2*b*. A detection sensor 5 for detecting the copy paper sheets is provided on the bottom face of the recessed portion 2*a*. An opening 3*a* is formed at a substantially central portion of the side regulating plate 3 so as to expose the detection sensor 5. The intermediate copy tray 1 is provided, at its forward end portion in the direction of the arrow A, with a paper feeding roller 6 such that the copy paper sheets stored in the intermediate copy tray 1 are refed from the intermediate copy tray 1 sheet by sheet by the paper feeding roller 6. The side regulating plates 3 and 4 are movably fitted into the recessed portions 2*a* and 2*b* respectively, so as to be displaced in the lateral direction perpendicular to the direction of the arrow A. A slot 7 is formed in each of the recessed portions 2*a* and 2*b*. As shown in FIG. 3, a rack gear 8 is secured to the bottom face of the side regulating plate 3 through a support portion 8*a* fitted into the slot 7 so as to be exposed at one side face of the intermediate copy tray 1. The rack gear 8 is held in engagement with a pinion gear 10 mounted on a rotary shaft 9*a* of a motor 9. The motor 9 is a reversible DC motor. It is to be noted that although not specifically shown, the rack gear 8, the motor 9 and the pinion gear 10 are mounted on the side regulating plate 4 in the same manner as the side regulating plate 3 of FIG. 3. Thus, each of the side regulating plates 3 and 4 can be respectively displaced by the rack gear 8, the motor 9 and the pinion gear 10 in the lateral direction perpendicular to the feed direction (arrow A) of the copy paper sheets.

Figure 5A:
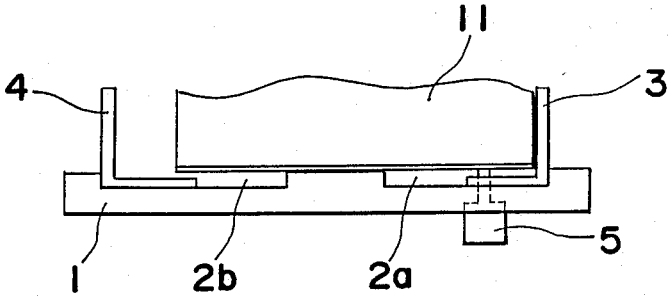
FIGS. 5A to 5C are views explanatory of the operation of the intermediate copy tray of FIG. 2.
Figure 5B:
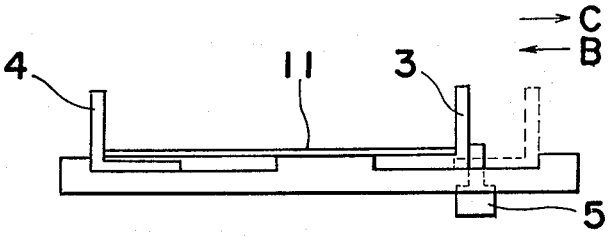
Figure 5C:
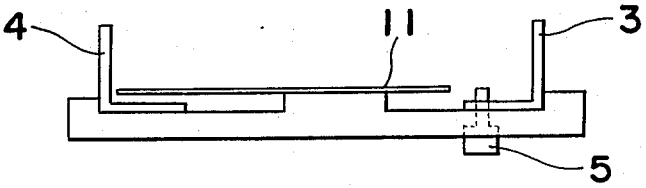

FIGS. 5A to 5C show the operation of the intermediate copy tray 1. When a copy paper sheet 11 is supplied to the intermediate copy tray 1, the side regulating plates 3 and 4 are, respectively, disposed at lateral outermost positions in the recessed portions 2*a* and 2*b*. At this time, the detection sensor 5 is exposed at a position of supply of the copy paper sheet 11 to the intermediate copy tray 1 so as to detect the copy paper sheet 11 supplied to the intermediate copy tray 1. When the copy paper sheet 11 has been supplied to the intermediate copy tray 1 upon lapse of a predetermined time period after detection of the copy paper sheet 11 by the detection sensor 5, the rotary shaft 9*a* of the motor 9 is rotated in the direction of the arrow D in FIG. 3 and thus, the side regulating plate 3 is driven in the direction of the arrow B as shown in FIG. 5B. Thus, the copy paper sheet 11 is displaced by the side regulating plate 3 to a storage position where the copy paper sheet 11 is held in contact with the side regulating plate 4. At this time, the copy paper sheet 11 is brought out of contact with the detection sensor 5 and thus, the detection sensor 5 is set in a state where the detection sensor 5 does not detect the copy paper sheet 11. Thereafter, the rotary shaft 9*a* of the motor 9 is rotated in the direction of the arrow E in FIG. 3, so that the side regulating plate 3 is displaced in the direction of the arrow C in FIG. 5B and thus, the side regulating plate 3 is disposed at the lateral outermost position in the recessed portion 2*a* as shown in FIG. 5C. At this time, the copy paper sheet 11 remains at the storage position of FIG. 5B and therefore, the detection sensor 5 is still set in the state where the detection sensor 5 does not detect the copy paper sheet 11.

By the above described arrangement of the intermediate copy tray, the side regulating plate 3 is driven after supply of one copy paper sheet to the intermediate copy tray so as to displace the copy paper sheet to the position where the detection sensor 5 does not detect the copy paper sheet, whereby when a plurality of the copy paper sheets are continuously supplied to the intermediate copy tray, a state of supply of each of the copy paper sheets can be detected by the detection sensor 5.

Accordingly, in the copy storing tray of the present invention, each time supply of one copy paper sheet to the copy storing tray has been completed, the copy paper sheet is displaced to the position where the copy paper sheet is not detected by the detection means. Therefore, since the detection means does not detect the copy paper sheet until the next copy paper sheet is supplied to the copy storing tray, it becomes possible to determine whether or not the next copy paper sheet has been accurately supplied to the copy storing tray. Thus, after one copy paper sheet has been supplied to the copy storing tray, the side regulating plate is driven by the actuator means so as to displace the copy paper sheet to the position where the copy paper sheet is not detected by the detection means, whereby even when a plurality of the copy paper sheets are continuously supplied to the copy storing tray, it becomes possible to check whether or not each of all the copy paper sheets has been accurately supplied to the copy storing tray. Hence, in the case where a jam of the copy paper sheets has taken place, the jam can be detected immediately. Therefore, since the operation for eliminating the jam can be started promptly, the undesirable phenomenon whereby a number of sheets are jammed at one time, does not occur thereby simplifying the operation for eliminating the jam and preventing failure of the copying apparatus.

Meanwhile, in accordance with the present invention, since the position of the copy paper sheets can be accurately regulated in the lateral direction perpendicular to the direction of supply of the copy paper sheets to the copy storing tray, development of an error of a lateral central position of each of the copy paper sheets can be prevented at the time of refeeding of the copy paper sheets.

Figure 6:
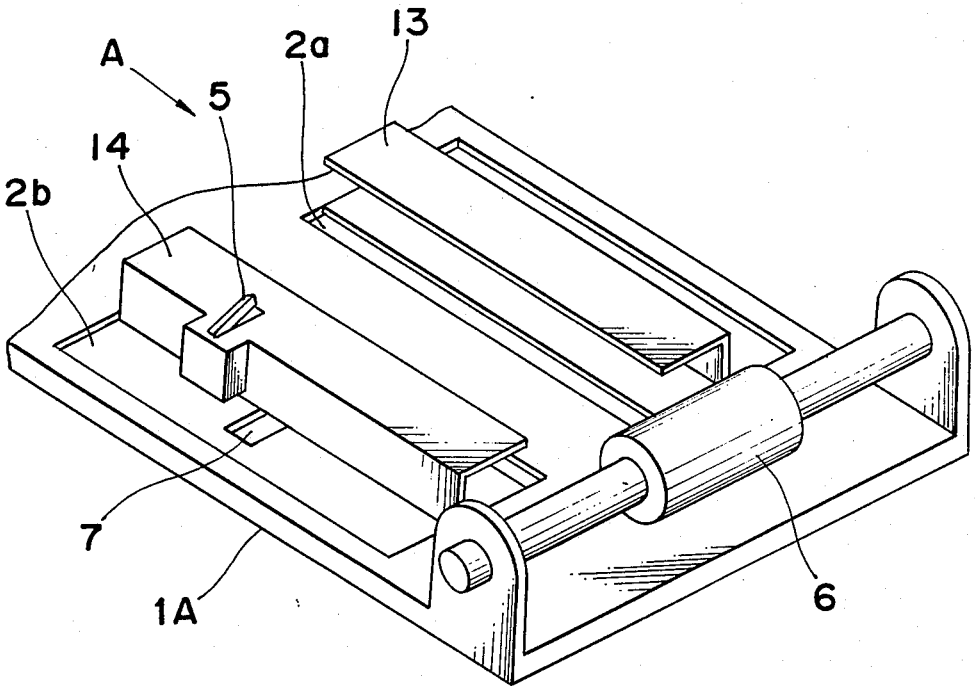
FIGS. 6 and 7 are views similar to FIGS. 2 and 3, respectively, particularly showing an intermediate copy tray according to a second embodiment of the present invention.
Figure 7:
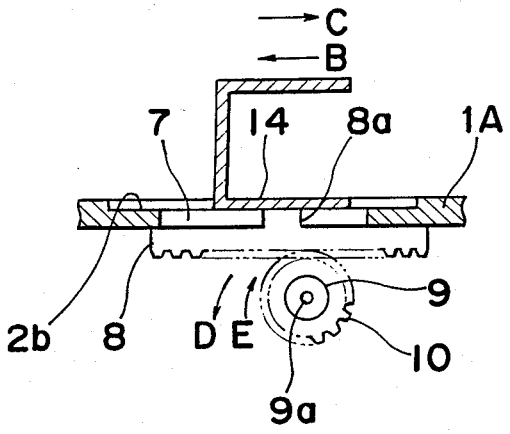

Referring to FIGS. 6 and 7, there is shown an intermediate copy tray 1A according to a second embodiment of the present invention. In the intermediate copy tray 1A, a pair of side regulating plates 13 and 14 of a substantially U-shaped cross section are fitted into the recessed portions 2*a* and 2*b*, respectively. The detection sensor 5 is provided on an upper face of one of the side regulating plates 13 and 14, here the side regulating plate 14. Since other constructions of the intermediate copy tray 1A are similar to those of the intermediate tray 1, a detailed description thereof is provided for the sake of brevity. Thus, when the rotary shaft 9*a* of the motor 9 is rotated in the direction of the arrow D in FIG. 7, the side regulating plate 14 is displaced in the direction of the arrow B in FIG. 7. On the contrary, when the rotary shaft 9*a* is rotated in the direction of the arrow E, the side regulating plate 14 is displaced in the direction of the arrow C in FIG. 7.

Figure 8A:
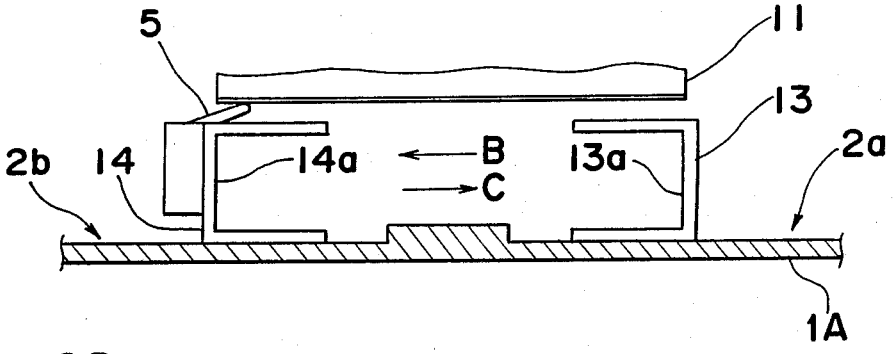
FIGS. 8A to 8C are views explanatory of the operation of the intermediate copy tray of FIG. 6.
Figure 8B:
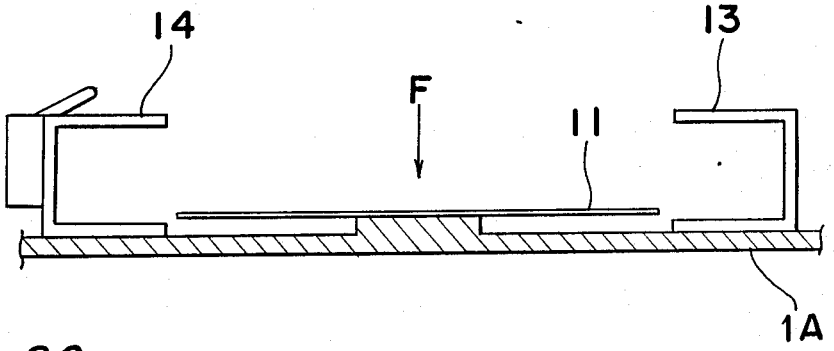
Figure 8C:
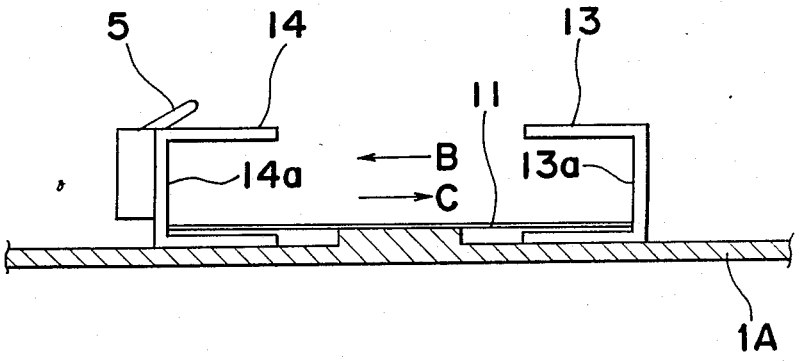

FIGS. 8A to 8C show the operation of the intermediate copy tray 1A. When one copy paper sheet 11 is supplied to the intermediate copy tray 1A, the side regulating plates 13 and 14 are set such that a distance between an inner side face 13*a* of the side regulating plate 13 and an inner side face 14*a* of the side regulating plate 14 is equal to a width of the copy paper sheet 11 measured in the lateral direction perpendicular to the feed direction (arrow A) of the copy paper sheet 11, as shown in FIG. 8A. When the copy paper sheet 11 is supplied to the intermediate copy tray 1A from above in this state, the lower face of the copy paper sheet 11 is brought into contact with the detection sensor 5 provided on the upper face of the side regulating plate 14. Thus, the detection sensor 5 is turned on so as to detect supply of the copy paper sheet 11 to the intermediate copy tray 1A. Upon lapse of a predetermined time period after turning on of the detection sensor 5, the side regulating plates 13 and 14 are, respectively, displaced in the recessed portions 2*a* and 2*b* in the directions of the arrows C and B, as shown in FIG. 8B. At this time, the side regulating plates 13 and 14 are displaced to positions where the upper faces of the side regulating plates 13 and 14 do not come into contact with the copy paper sheet 11. Thus, the copy paper sheet 11 drops in the direction of the arrow F in FIG. 8B and comes into contact with the upper face of the intermediate copy tray 1A.

When the copy paper sheet 11 has come into contact with the upper face of the intermediate copy tray 1A, the side regulating plates 13 and 14 are, respectively, displaced in the directions of the arrows B and C as shown in FIG. 8C so as to be returned to the initial positions of FIG. 8A. At this time, since the distance between the inner side face 13*a* of the side regulating plate 13 and the inner side face 14*a* of the side regulating plate 14 is set to the width of the copy paper sheet 11, the inner side faces 13*a* and 14*a* of the side regulating plates 13 and 14 are brought into contact with opposite side edges of the copy paper sheet 11 and thus, it becomes possible to regulate a storage position of the copy paper sheet 11. Meanwhile, at this time, since the detection sensor 5 provided on the upper face of the side regulating plate 14 is set in a free state, the detection sensor 5 is capable of detecting the next copy paper sheet.

As described above, in the intermediate copy tray 1A, the supplied copy paper 11 is temporarily retained on the upper faces of the side regulating plates 13 and 14 and at the same time, a state of supply of the copy paper sheet 11 to the intermediate copy tray 1A is detected by the detection sensor 5. Subsequently, the side regulating plates 13 and 14 are displaced away from each other such that the copy paper sheet 11 is dropped between the side regulating plates 13 and 14 and then, the side regulating plates 13 and 14 are returned to the original positions in accordance with size of the copy paper sheet 11 such that the storage position of the copy paper sheet 11 can be regulated by the inner side faces 13*a* and 14*a* of the side regulating plates 13 and 14.

Meanwhile, in the case where copy paper sheets having a plurality of sizes are supplied to the intermediate copy tray, it can be so arranged that initial positions of the side regulating plates are set to the respective sizes of the copy paper sheets such that the side regulating plates are displaced to the corresponding initial positions when one of the sizes of the copy paper sheets has been selected, whereby a state of supply of the copy paper sheets to the intermediate copy tray can be detected by the single detection sensor regardless of the sizes of the copy paper sheets supplied to the intermediate copy tray.

By the above described arrangement of the intermediate copy tray according to the second embodiment of the present invention, the side regulating plates are driven by the actuator means after completion of supply of one copy paper sheet to the intermediate copy tray such that the supplied copy paper sheet is displaced in the vertical direction to the position where the copy paper sheet is not detected by the detection means. Thus, even when a plurality of the copy paper sheets are continuously supplied to the intermediate copy tray, it becomes possible to check whether or not each of all the copy paper sheets has been accurately supplied to the intermediate copy tray.

Figure 9:
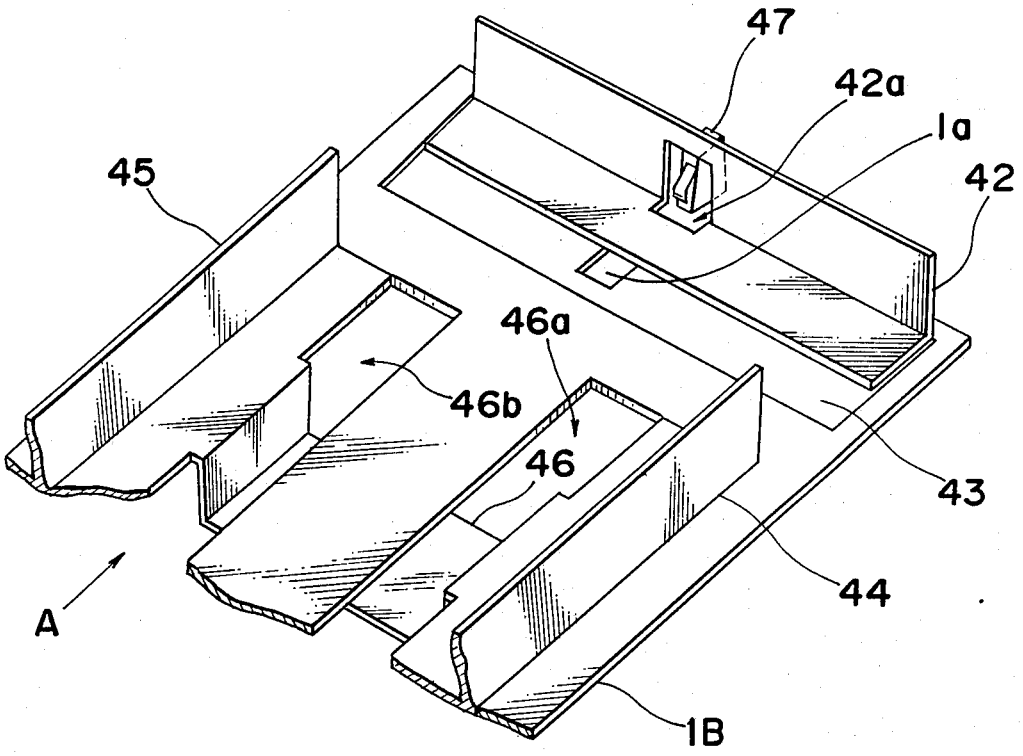
FIG. 9 is a fragmentary perspective view of an intermediate copy tray according to a third embodiment of the present invention.
Figure 10:
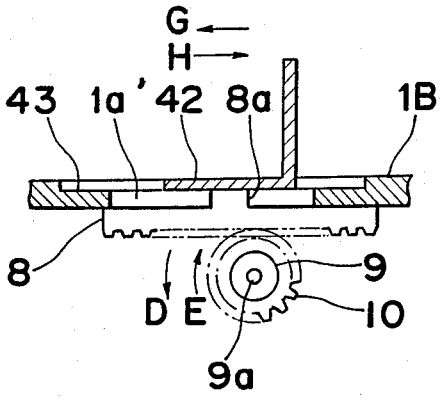
FIG. 10 a fragmentary sectional view of the intermediate copy tray of FIG. 9.

Referring further to FIGS. 9 and 10, there is shown an intermediate copy tray 1B according to a third embodiment of the present invention. The intermediate copy tray 1B is formed, at its forward end portion in the feed direction (arrow A) of the copy paper sheets, with a recessed portion 43. A front regulating plate 42 for regulating a position of leading edges of the copy paper sheets stored in the intermediate copy tray 1B is fitted into the recessed portion 43. An opening 42*a* is formed at a central portion of the front regulating plate 42 so as to expose a detection sensor 47 for detecting the copy paper sheets. A pair of elongated openings 46*a* and 46*b* are formed at a substantially central portion of the intermediate copy tray 1B so as to extend in parallel with the feed direction (arrow A) of the copy paper sheets. A pair of side regulating plates 44 and 45 are projected upwardly from the elongated openings 46*a* and 46*b* and are coupled, below the intermediate copy tray 1B, with each other by a coupling portion 46.

A slot 1*a* is formed in the recessed portion 43. The rack gear 8 is secured to a side face of the front regulating plate 42 through the support portion 8*a* fitted into the slot 1*a*. The rack gear 8 exposed at the side face of the intermediate copy tray 1B is held in engagement with the pinion gear 10 mounted on the rotary shaft 9*a*of the motor 9. By this arrangement, when the rotary shaft 9*a* of the motor is rotated in the direction of the arrow D, the front regulating plate 42 is displaced in the direction of the arrow G in FIG. 10. On the contrary, when the rotary shaft 9*a* is rotated in the direction of the arrow E, the front regulating plate 42 is displaced in the direction of the arrow H. It is to be noted that the direction of the arrow H is identical with the feed direction (arrow A) of the copy paper sheets.

Figure 11A:
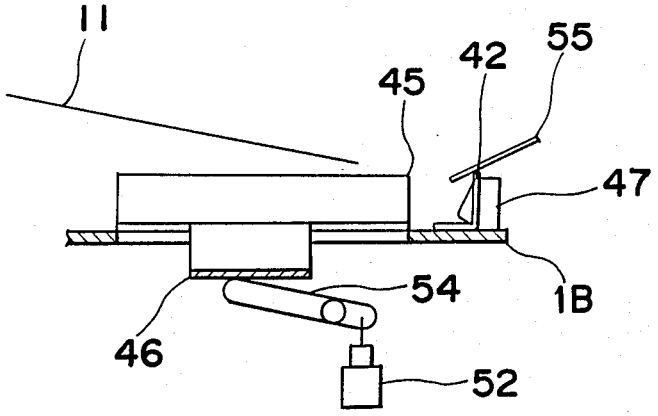
FIGS. 11A to 11C are views explanatory of the operation of the intermediate copy tray of FIG. 9.
Figure 11B:
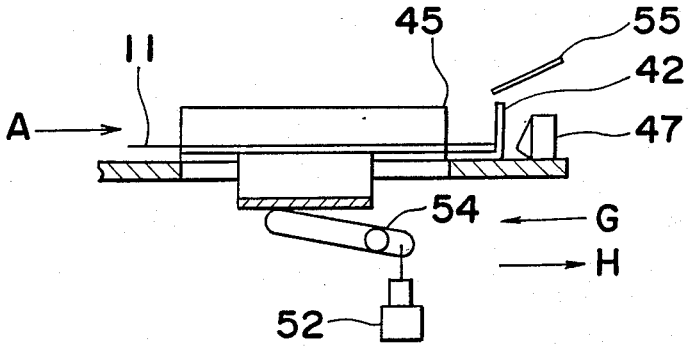
Figure 11C:
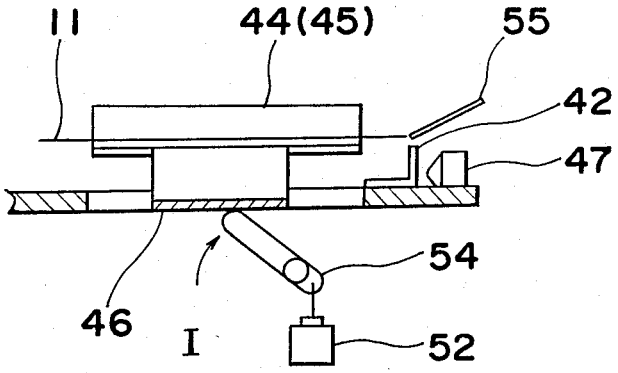

FIGS. 11A to 11C show operation of the intermediate copy tray 1B. When a copy paper sheet 11 is supplied to the intermediate copy tray 1B, the front regulating plate 42 is stopped at such a position as to expose the detection sensor 47 from the front regulating plate 42 in the direction opposite to the feed direction (arrow A) of the copy paper sheets. Hence, the leading edge of the copy paper sheet 11 is brought into contact with the detection sensor 47 and thus, the detection sensor 47 is capable of detecting supply of the copy paper sheet 11 to the intermediate copy tray 1B.

Upon lapse of a predetermined time period after the detection sensor 47 has detected supply of the copy paper sheet 11 to the intermediate copy tray 1B, the intermediate copy tray 1B is driven in the direction of the arrow G, as shown in FIG. 11B. Thus, the copy paper sheet 11 is stored at a predetermined position in the intermediate copy tray 1B so as to be brought out of contact with the detection sensor 47. Subsequently, the front regulating plate 42 is displaced in the direction of the arrow H, i.e. in the feed direction (arrow A) of the copy paper sheets and thus, the front regulating plate 42 is again stopped at the position of FIG. 11A. Hence, the detection sensor 47 is projected from the front regulating plate 42 in the direction of the arrow G and therefore, is capable of detecting the next copy paper sheet. When all the copy paper sheets have been supplied to the intermediate copy tray 1B, a solenoid 52 is turned on so as to rotate a contact member 54 in the direction of the arrow I. Through this rotation of the contact member 54, a free end of the contact member 54 upwardly depresses the coupling portion 46 together with the side regulating plates 44 and 45. Thus, the copy paper sheet 11 is brought to a position where the copy paper sheet 11 is engageable with a paper feeding guide 55 so as to be refed by the paper feeding roller (not shown).

As described above, in the intermediate copy tray 1B, when the copy paper sheet is supplied to the intermediate copy tray 1B, the front regulating plate 42 is stopped at the position where the detection sensor 47 can be brought into contact with the copy paper sheet. Then, after the detection sensor has detected supply of the copy paper sheet to the intermediate copy tray 1B, the front regulating plate 42 is displaced to the position where the detection sensor 47 is held out of contact with the copy paper sheet. Thus, the supplied copy paper sheet is brought out of contact with the detection sensor 47 and at the same time, is stored at the predetermined position. Subsequently, the front regulating plate 42 is immediately returned to the position where the detection sensor 47 can be brought into contact with the copy paper sheet so as to be set in a waiting state for waiting for supply of the next copy paper sheet to the intermediate copy tray 1B. Therefore, the detection sensor 47 is capable of detecting a state of supply of each of all the supplied copy paper sheets.

By the above described arrangement of the intermediate copy tray according to the third embodiment of the present invention, after one copy paper sheet has been supplied to the intermediate copy tray, the front regulating plate is driven by the actuator means so as to displace the copy paper sheet to the position where the supplied cop paper sheet is not detected by the detection means. Accordingly, even when a plurality of the copy paper sheets are continuously supplied to the intermediate copy tray, it becomes possible to check whether or not each of all the copy paper sheets has been accurately supplied to the intermediate copy tray. In accordance with the third embodiment of the present invention, the leading edges of the copy paper sheets can be positioned accurately such that the leading edges of the copy paper sheets are caused to coincide with forward ends of images of the copy paper sheets at the time of refeeding of the copy paper sheets.

Figure 12:
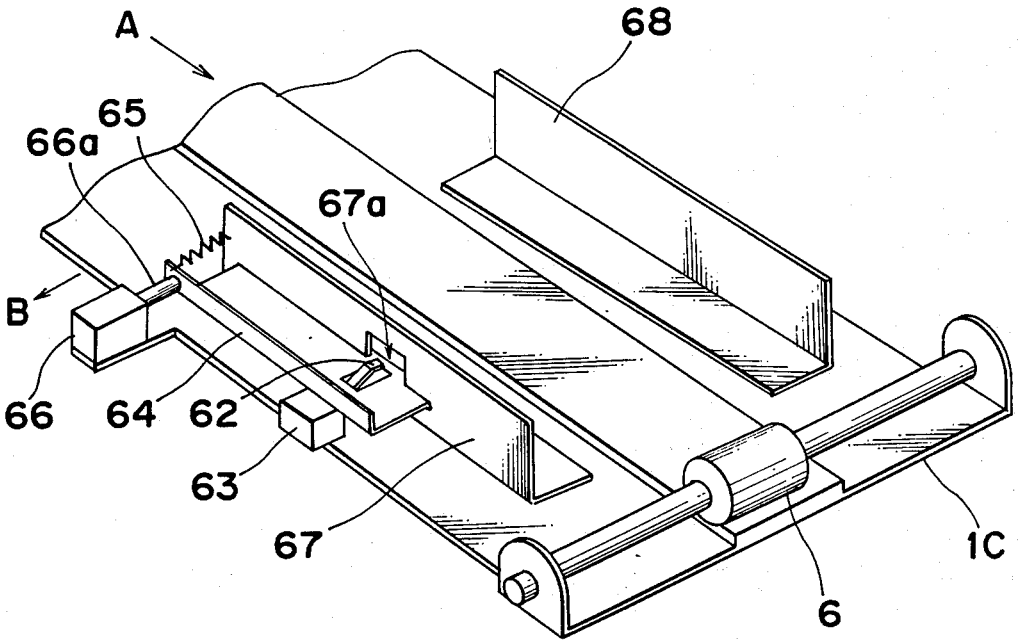
FIG. 12 is a fragmentary perspective view of an intermediate copy tray according to a fourth embodiment of the present invention.

Referring further to FIG. 12, there is shown an intermediate copy tray 1C according to a fourth embodiment of the present invention. A pair of side regulating plates 67 and 68 are provided on the upper face of the intermediate copy tray 1C. The side regulating plates 67 and 68 are provided such that respective inner side faces of the side regulating plates 67 and 68 regulate lateral positions of the copy paper sheets stored in the intermediate copy tray 1C. The paper feeding roller 6 is provided at the forward end portion of the intermediate copy tray 1C in the feed direction (arrow A) of the copy paper sheets. The paper feeding roller 6 is provided for refeeding, through its rotation, the copy paper sheets stored in the intermediate copy tray 1C. An opening 67*a* for receiving a slide plate 64 is formed on the side regulating plate 67. A detection sensor 63 having a contact portion 62 is attached to the slide plate 64 such that the contact portion 62 projects upwardly from the upper face of the slide plate 64. A spring 65 is attached, at its one end, to the side regulating plate 67 and is coupled, at the other end, with the slide plate 64 such that the slide plate 64 is urged towards the side regulating plate 67 by an elastic force of the spring 65.

Meanwhile, an actuator 66*a* of a solenoid 66 is secured to the slide plate 64. Electric power is supplied to the solenoid 66 from a drive unit (not shown) for driving the solenoid 66. Thus, when the solenoid 66 is turned on by the drive unit, the actuator 66*a* is retracted in the direction of the arrow B.

Figure 13A:
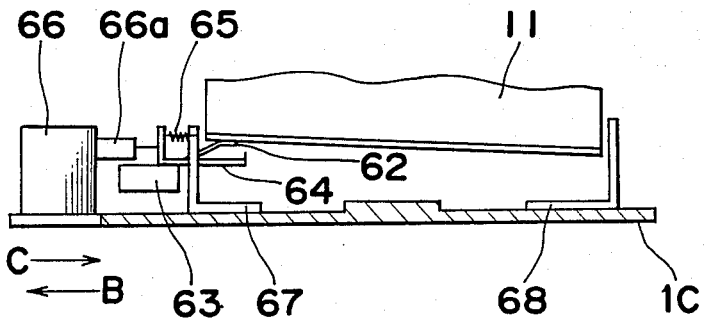
FIGS. 13A and 13B are views explanatory of the operation of the intermediate copy tray of FIG. 12.
Figure 13B:
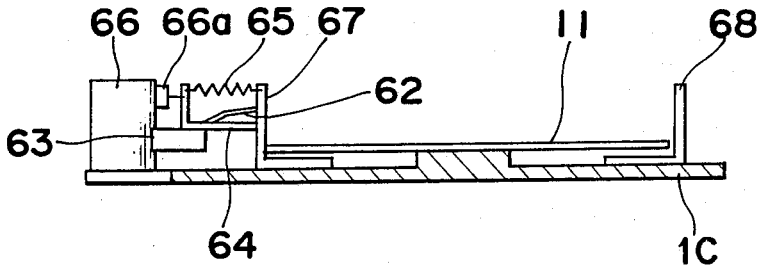

FIGS. 13A and 13B show operation of the intermediate copy tray 1C. When a copy paper sheet 11 is supplied to the intermediate copy tray 1C, the solenoid 66 is turned off, as shown in FIG. 13A, and the elastic force of the spring 65 is applied to the slide plate 64 in the direction of the arrow C. Therefore, the slide plate 64, having the detection sensor 63 attached thereto, is projected between the side regulating plates 67 and 68 and thus, the contact portion 62 of the detection sensor 63 is also projected between the side regulating plates 67 and 68. When the copy paper sheet 11 is supplied to the intermediate copy tray 1C in this state, the lower face of the copy paper sheet 11 is brought into contact with the contact portion 62.

Upon lapse of a predetermined time period after contact of the lower face of the copy paper sheet 11 with the contact portion 62 of the detection sensor 63, the solenoid 66 is turned on, as shown in FIG. 13B. Thus, the actuator 66*a* of the solenoid 66 is retracted in the direction of the arrow B, so that the slide plate 64 is also displaced in the direction of the arrow B against the elastic force of the spring 65. At this time, the slide plate 64 is not projected between the side regulating plates 67 and 68, so that the copy paper sheet 11 drops downwardly without being in contact with the contact portion 62 and thus, the lateral positions of the copy paper sheet 11 are regulated by the inner side faces of the side regulating plates 67 and 68 such that the copy paper sheet 11 is stored on the upper face of the intermediate copy tray 1C.

As described above, when a copy paper sheet 11 is supplied to the intermediate copy tray 1C, the contact portion 62 of the detection sensor 63 is projected into the storage position of the copy paper sheet 11 so as to be brought into contact with the supplied copy paper sheet 11. Thereafter, when the detection sensor 63 has detected the copy paper sheet 11 through contact of the copy paper sheet 11 with the contact portion 62, the contact portion 62 is displaced from the storage position of the copy paper sheet 11 to the retracted position such that the copy paper sheet 11 is dropped downwardly. Thus, the copy paper sheet 11 is stored at the storage position regulated by the side regulating plates 67 and 68.

Subsequently, the contact portion 62 is again projected into the storage position of the copy paper sheet 11, so that the next copy paper sheet and the contact portion 62 can be brought into contact with each other and thus, it becomes possible to accurately detect a state of supply of each of the copy paper sheets supplied successively to the intermediate copy tray 1*c*.

By the above described arrangement of the intermediate copy tray according to the fourth embodiment of the present invention, the drive means for driving the detection means is actuated after completion of supply of one copy paper sheet to the intermediate copy tray so as to displace the detection means to the position where the supplied copy paper sheet is not detected by the detection means. Thus, even when a plurality of the copy paper sheets are continuously supplied to the intermediate copy tray, it becomes possible to check whether or not each of all the copy paper sheets has been accurately supplied to the intermediate copy tray.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A copy storage tray, assembly for storing copy paper sheets in a copy storage tray, which is provided with a detection means for detecting the presence of said copy paper sheets at the time of supply of said copy paper sheets to said copy storage tray, comprising:

a pair of side regulating plates for regulation in a lateral direction, perpendicular to a direction of supply of the copy paper sheets to said copy storing tray, and positioning said copy paper sheets in said copy storage tray, at least one of which is movably provided such that it is displaceable in said lateral direction and accordingly displace therewith said respective copy paper sheets;

a copy storage tray with lateral recessed portions into which said side regulating plates are fitted;

copy paper detection means provided on a bottom face of at least one of said recessed portions of said copy storage tray corresponding to an opening formed at a substantially central portion of said at least one side regulating plate, for detecting the presence of said copy paper sheets; and an actuator means for displacing said at least one side regulating plate in said lateral direction, whereby at the time when each of said copy paper sheets has been supplied to said copy storage tray and is detected by said detection means, said at least one side regulating plate is displaced in said lateral direction by said actuator means so as to displace each of said copy paper sheets in a horizontal direction to a predetermined position such that each of said copy paper sheets is no longer detected by said detection means.

2. A copy storage tray assembly as in claim 1, wherein said actuator means includes a rack gear secured to said at least one side regulating plate, a pinion gear in mesh with said rack gear and a motor for driving said pinion gear.

3. A copy storage tray assembly for storing copy paper sheets in a copy storage tray, which is provided with a detection means for detecting the presence of said copy paper sheets at the time of supply of said copy paper sheets to said copy storage tray, comprising:

a front regulating plate for regulating, in a direction of supply of said copy paper sheets to said copy storage tray, a position of a leading edge of each of said copy paper sheets stored in said copy storage tray, said front regulating plate movably provided so as to be displaceable both in the direction of supply of said copy paper sheets to said copy storage tray and in an opposite direction to said direction of supply of said copy paper sheets, so as to accordingly displace therewith said respective copy paper sheets;

copy paper detection means provided in an opening formed at a central portion of said front regulating plate for detecting the presence of said copy paper sheets; and an actuator means for displacing said front regulating plate in said direction of supply of said copy paper sheets to said copy storage tray and in said opposite direction, whereby at the time when each of said copy paper sheets has been supplied to said copy storage tray and is detected by said detection means, said front regulating plate is displaced by said actuator means in said direction opposite to said direction of supply of said copy paper sheets to said copy storage tray so as to displace each of said copy paper sheets to a predetermined position such that each of said copy paper sheets is no longer detected by said detection means.

4. A copy tray assembly as in claim 3, wherein said actuator means includes a rack gear secured to said front regulating plate, a pinion gear in mesh with said rack gear and a motor for driving said pinion gear.

5. A copy storage tray assembly for storing copy paper sheets in a copy storage tray, which is provided with a detection means for detecting the presence of said copy paper sheets at the time of supply of said copy paper sheets to said copy storage tray, comprising:

a pair of side regulating plates for regulation in a lateral direction positioning of said copy paper sheets stored in said copy storage tray;

a movable detection means provided within at least one of said side regulating plates so as to project between said pair of side regulating plates to detect the presence of said copy paper sheets at the time of supply of said copy paper sheets to said copy storage tray, which detection means is displaceable to a retracted position such that said copy paper sheets are not detected by said detection means; and an actuator means for displacing said detection means to said retracted position;

whereby as each of said copy paper sheets is supplied to said copy storage tray, said actuator means temporarily displaces said detection means to said retracted position and then, returns said detection means to a detection position for detecting the next one of the copy paper sheets.

6. A copy storage tray assembly as in claim 5, wherein said actuator means is a solenoid.

7. A copy storage tray assembly for storing copy paper sheets in a copy storage tray, which is provided with a detection means for detecting the presence of said copy paper sheets at the time of supply of said copy paper sheets to said copy storage tray, comprising:

a pair of U-shaped cross-sectional side regulating plates for positioning said copy paper sheets in said copy storage tray both of which are movable so as to be displaced in their respective lateral directions;

detection means provided on an upper face of at least one of said side regulating plates so as to detect when a copy paper sheet is supplied to said copy storage tray from above said copy storage tray, a lower face of said copy paper sheet being brought into contact with said detection means; and actuator means for displacing each of said side regulating plates in said respective lateral directions whereby, at a time when each of said copy paper sheets has been supplies to said copy storage tray and is detected by said detection means, said side regulating plates are displaced in said lateral directions by said actuator means so as to displace each of said copy paper sheets in a vertical direction to a predetermined position such that each of said copy paper sheets is no longer detected by said detection means, following which said side regulating plates are returned medially by said actuator means to their initial position which is set to the width of a copy paper sheet.

8. A copy storage tray assembly as in claim 7, wherein said actuator means includes a rack gear secured to said at least one side regulating plate, a pinion gear in mesh with said rack gear and a motor for driving said pinion gear.

* * * * *